United States Patent [19]

Rutfield et al.

[11] Patent Number: 4,988,914

[45] Date of Patent: Jan. 29, 1991

[54] RED FLUORESCENT LAMP SUITABLE FOR REPROGRAPHIC APPLICATIONS

[75] Inventors: Sharon B. Rutfield, No. Chelmsford; Steven C. Schlitt, Merrimack, both of Mass.

[73] Assignee: GTE Products Corporation, Danvers, Mass.

[21] Appl. No.: 341,878

[22] Filed: Apr. 24, 1989

[51] Int. Cl.[5] ..... H01J 61/38; H01J 61/44

[52] U.S. Cl. ..... 313/486; 313/112

[58] Field of Search ..... 313/486, 493, 112

[56] References Cited

U.S. PATENT DOCUMENTS 1,971,941 8/1934 Pirvani ..... 313/112

4,691,140 9/1987 Sakakibara et al. ..... 313/486

FOREIGN PATENT DOCUMENTS 2646615 4/1977 Fed. Rep. of Germany ..... 313/486

*Primary Examiner*—Sandra L. O'Shea

*Attorney, Agent, or Firm*—Carlo S. Bessone

[57] ABSTRACT

A fluorescent lamp designed to emit light in the red region of the visible spectrum suitable for reprographic applications. The lamp includes a colored envelope (e.g., amber) which is capable of attenuating light below about 500 nanometers. A layer containing a single narrow-band phosphor having a peak emission in the wavelength region of from about 590 to 660 nanometers is disposed on the inner surface of the envelope. The phosphor layer may consist of a mixture the narrow-band phosphor and a predetermined amount of alumina. Preferably, the alumina by weight is within the range of from about 55 percent to about 95 percent by weight of the phosphor.

9 Claims, 3 Drawing Sheets

RED FLUORESCENT LAMP SUITABLE FOR REPROGRAPHIC APPLICATIONS

FIELD OF THE INVENTION

This invention relates in general to fluorescent lamps and pertains, more particularly, to a fluorescent lamp wherein the light output therefrom is confined to primarily the red region of the spectrum.

BACKGROUND OF THE INVENTION

Fluorescent lamps are well known in the art and are used for a variety of types of lighting applications. Such lamps are characterized as low pressure arc discharge lamps and include an elongated envelope, whose internal surface is coated with phosphor, an electrode structure at each end of the envelope. The envelope also contains a quantity of an ionizable material, such as mercury, and a fill gas at a low pressure, for example in the order of 1–5 torr. The fill gas can be, for example argon or krypton, or a mixture of these and other gases.

When a voltage is applied across the electrodes, electrons will be emitted, ionizing the gas inside the envelope. The resultant ionization and recombination of ions and electrons produce 253.7 nm. radiation which is converted by means of the phosphor into radiation of a longer wavelength and a spectral distribution, depending on the phosphor material used, in the near ultra-violet or in the visible part of the spectrum.

One such lighting application in which fluorescent lamps are extensively used is in reprographic equipment for photocopying. Equipment used in today's reprographic technologies utilizes varied illumination and optical processes to accomplish the desired duplicating process. The fundamentals of the electrophotographic cycle are: a grid-controlled primary charger, an organic photo-conductive film belt, and a semi-solid development process.

Several different illumination sources are used in these processes. The type of source and its location are dependent on the manufacturer, make, and model of the specific machine. Most reprographic equipment, however, does include the use of at least one fluorescent light source. In some copiers, a red 12-watt fluorescent light source is utilized in three different parts of the reprographic process. First, the auxiliary erase which follows the exposure area. During this operation, the light is used to expose the photoconductor in order to remove any unwanted charges. Second, the post development erase wherein light is used to expose any remaining charges on the film. This process reduces the electrical stress on the photoconductor. Third, the cleaning assist area which has the same configuration as the post development erase area.

Fluorescent lamps which are designed to emit a selected color are well known in the art and achieve the desire color-controlled light output by employing suitable combinations of phosphors and light-filtering materials. For example, in the case of a red-emitting fluorescent lamp designed for use as a light source for a photographic dark room or as a decorative lamp, a phosphor coating, that emits mainly in the red region of the spectrum in response to the ultraviolet radiations produced by the arc discharge, is combined with an underlying layer of red pigment that filters out all of the visible radiation below a certain wavelength (600 nanometers, for example). A prior art fluorescent lamp which utilizes this color-controlling concept and combines a suitable phosphor and a filter material to provide a lamp which emits mainly in the red region of the spectrum is disclosed in U.S. Pat. No. 3,365,232 which issued to Repsher on Jan. 23, 1968.

While the transmitted radiation provides the pure red light which is desired, the use of thin layers of pigment material in fluorescent lamps inherently result in lamp-starting problems. In order to avoid such problems, prior art lamps include various additives in the phosphor to facilitate starting of the fluorescent lamp. In the case of a red-emitting fluorescent lamp that utilizes a thin layer of cadmium-selenium sulfide pigment as the filter component together with a phosphor which has an emission mainly in the red portion of the spectrum, a prior art practice was to add a mixture of barium sulfate and silica to the phosphor as a starting aid in amounts that frequently exceeded 40% by weight or more of the phosphor coating. The addition of such additives has been found to not completely solve the lamp-starting problem. Since such additives are inert (non-fluorescent), they reduce the "red light" output of the lamp.

Other lamps, such as described in U.S. Pat. No. 4,500,810 which issued to Graff on Feb. 19, 1985, include an additional layer of a conductive material (such as tin oxide) on the inner surface of the glass envelope. Overlying layers of a light-filtering pigment material and a phosphor are disposed over the conductive layer. The addition of a layer of conductive material to improve lamp starting adds to the manufacturing complexity of the lamp.

Manganese-activated cadmium metaborate phosphor has been used in the past in conjunction with a cadmium-based red pigment filter coat. Because of increased restrictions on the use of cadmium, it is desirable to have a lamp source suitable for reproductive applications which is free of cadmium.

U.S. Pat. No. 4,547,700, which issued to Landry on Oct. 15, 1985 and is assigned to the same Assignee as the present application, discloses the use of alumina in a dual-layer fluorescent lamp to increase the lumen maintenance. The alumina, which is included within the second phosphor layer, is in an amount from about 6 to 50 percent by weight of the second phosphor layer.

SUMMARY OF THE INVENTION

It is, therefore, an object of the present invention to obviate the disadvantages of the prior art.

It is another object of the invention to provide an improved fluorescent lamp which does not require either a layer of a conductive material or a filter coat disposed within the envelope.

It is still another object of the invention to provide an improved fluorescent lamp which does not contain cadmium.

It is still another object of the invention to provide such a fluorescent lamp which can be more readily manufactured.

These objects are accomplished in one aspect of the invention by the provision of a fluorescent lamp comprising a glass envelope having a substantially circular configuration in cross-section and having opposed end portions. The envelope is capable of attenuating radiation having wavelengths below about 500 nanometers. An electrode is located within a respective one of the opposed end portions. An ionizable medium is enclosed within the envelope and includes an inert starting gas and a quantity of mercury. The ionizable medium when energized generates a plasma discharge comprising ultraviolet radiation and a limited proportion of visible radiation. A phosphor means responsive to the ultraviolet radiation generated by the plasma discharge is disposed on the inner surface of the envelope. The phosphor means comprises a single narrow band emitting phosphor having a peak emission in the the wavelength region of from about 590 to 660 nanometers.

In accordance with further teachings of the present invention, the phosphor means contains one of at least europium-activated yttrium oxide, manganese-activated magnesium fluorogermanate, strontium magnesium orthophosphate and manganese, lead-activated calcium metasilicate.

In accordance with further aspects of the present invention, the phosphor means consists of a mixture of a single narrow band emitting phosphor and a predetermined amount of alumina. Preferably, the alumina is in the range of from about 55 percent to about 95 percent by weight of the single narrow band emitting phosphor.

In accordance with still further teachings of the present invention, the phosphor means contains a mixture of approximately 10 percent by weight europium-activated yttrium oxide and 90 percent by weight alumina.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
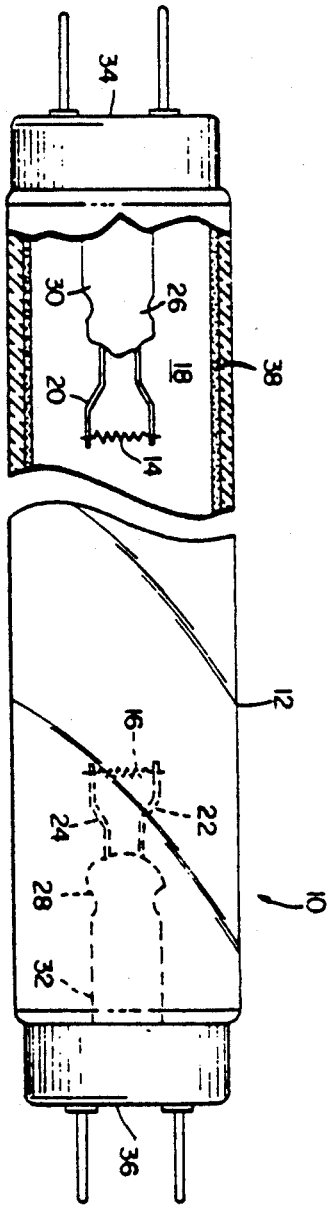
FIG. 1 represents a front elevational view, partially broken away, of a fluorescent lamp according to the present invention.
Figure 2:
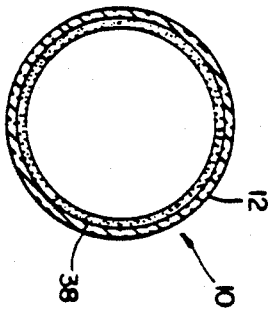
FIG. 2 is a cross-sectional view of the fluorescent lamp of FIG. 1.
Figure 3:
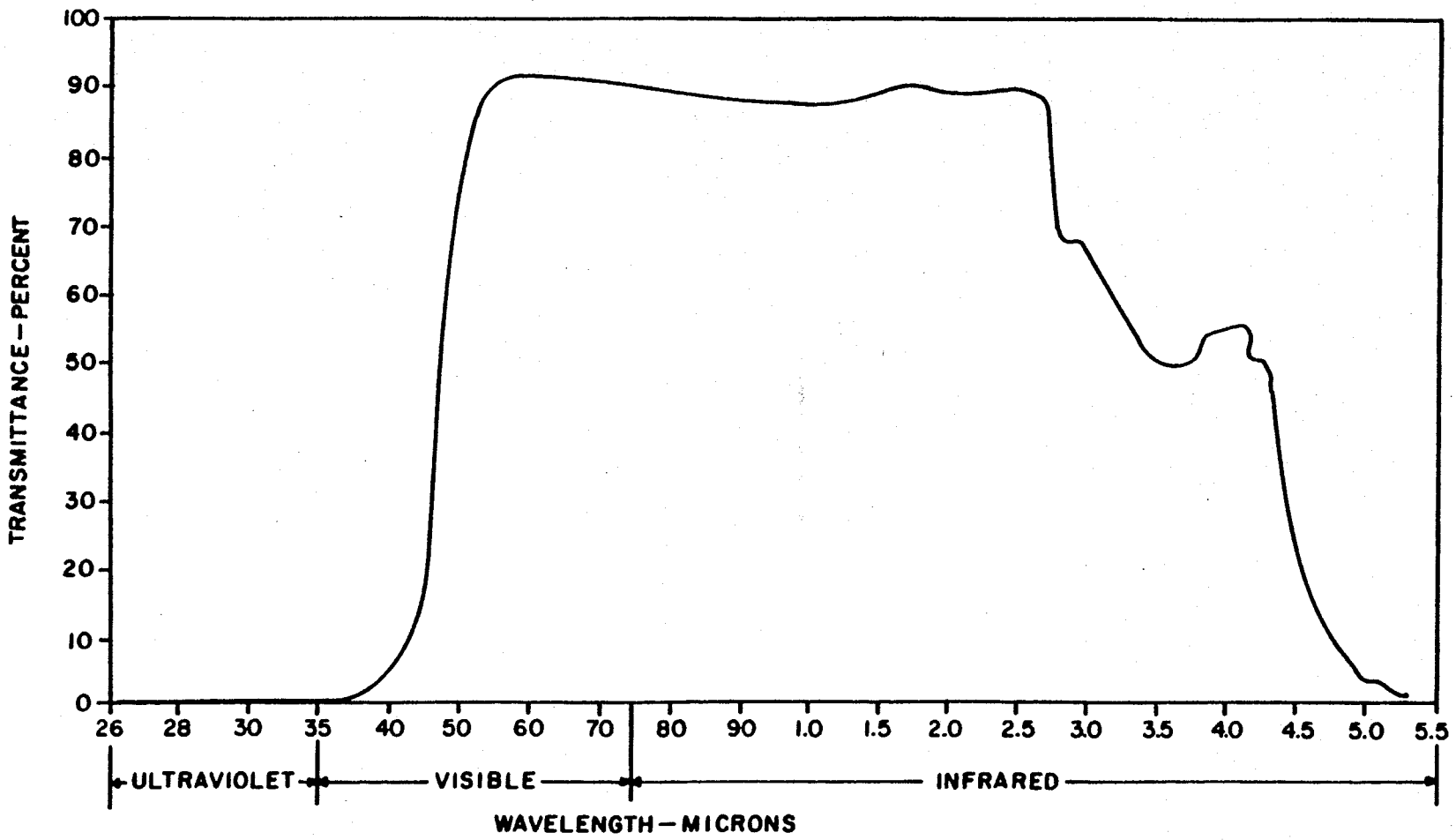
FIG. 3 is a graph depicting the transmission characteristics of a glass suitable for use as the envelope in the lamp of FIG. 1.

Referring to the drawings with greater particularity, there is illustrated in FIGS. 1 and 2 a fluorescent lamp 10. Lamp 10 is comprised of an elongated sealed glass envelope 12 of circular cross-section. According to the teachings of the present invention, envelope 12 is capable of attenuating (i.e., absorbing) radiation having wavelengths below about 500 nanometers. In the specific application in reprographic equipment, emission in the spectral range below 500 nanometers is detrimental to the function of the erasure process. One suitable type of glass is available from General Electric Company as type 355 amber-colored glass tubing. FIG. 3 is a graph depicting the transmission characteristics of this glass tubing. As can be seen, the glass transmits visible radiation greater than about 500 nanometers while attenuating radiation (visible and ultraviolet) less than about 500 nanometers.

Envelope 12 is filled with an inert gas such as argon and krypton at a low pressure, for example two torr, and a quantity of mercury, at least enough to provide a low vapor pressure of about six microns during operation. An electrode 14 and 16 is disposed at each end of envelope 12 supported by lead-in wires 18, 20 and 22, 24, respectively. The lead-in wires extend through glass presses 26, 28 in mount stems 30, 32 to the contacts in bases 34, 36 affixed to the ends of envelope 12.

A layer 38 comprising a single narrow band emitting phosphor is disposed on the inner surface of envelope 12. The phosphor has a peak emission in the wavelength of from about 590 nanometers to 660 nanometers. One suitable phosphor for layer 38 is europium-activated yttrium oxide phosphor which has a peak emission at approximately 612 nanometers and a bandwidth of 5 nanometers at half maximum height. Other possible phosphors include manganese-activated magnesium fluorogermanate having a peak emission at approximately 658 nanometers and a half height bandwidth of 14 nanometers; strontium magnesium orthophosphate having a peak emission at approximately 625 nanometers and a half height bandwidth of 124 nanometers; and manganese, lead-activated calcium metasilicate having a peak emission at approximately 615 nanometers and a half height bandwidth of 86 nanometers.

The single narrow band emitting phosphor may emit energy in excess of that which is needed for the reprographic process. In order to reduce the energy output of the lamp while still maintaining the spectral integrity of the lamp, the phosphor layer 38 contains a substantially homogeneous dispersion of particles of high-purity (i.e., 99.95 percent minimum) $Al_2O_3$ alumina. Preferably, the amount of alumina is within the range of from about 55 percent to about 95 percent by weight of the phosphor. One source of alumina is available from Reynolds Metal Company of Richmond Virginia and designated as High Purity Alumina RC-HPT-DBM. This material has a median particle size of about 0.85 micron and a surface area of about 3.6 to 4.6 square meters per gram.

A phosphor coating is prepared by first dispersing the alumina particles in a organic base system consisting of the phosphor particles and an organic solvent (e.g., xylol) together with known dispersion and adherence agents and a plasticizer. Next, the phosphor suspension is applied in the usual manner of causing the suspension to flow down the inner surface of the bulb. The solvent is allowed to evaporate leaving the binder, phosphor particles and alumina particles adhered to the bulb wall.

In a typical but non-limitative example of a fluorescent lamp in accordance with the teachings of the present invention, the fluorescent lamp is an F18.25"T5/R/RS type having a nominal envelope diameter of ⅝ inch and a longitudinal length (excluding the base pins) of approximately 18.25 inches. The bases were conventional T5 medium bipin bases. The envelope was type 355 amber glass tubing and contained a fill of argon at a pressure of approximately 4.2 torr. A phosphor mixture of approximately 10 percent by weight europium-activated yttrium oxide and 90 percent high-purity alumina is disposed on the surface of the amber-colored envelope.

Figure 4:
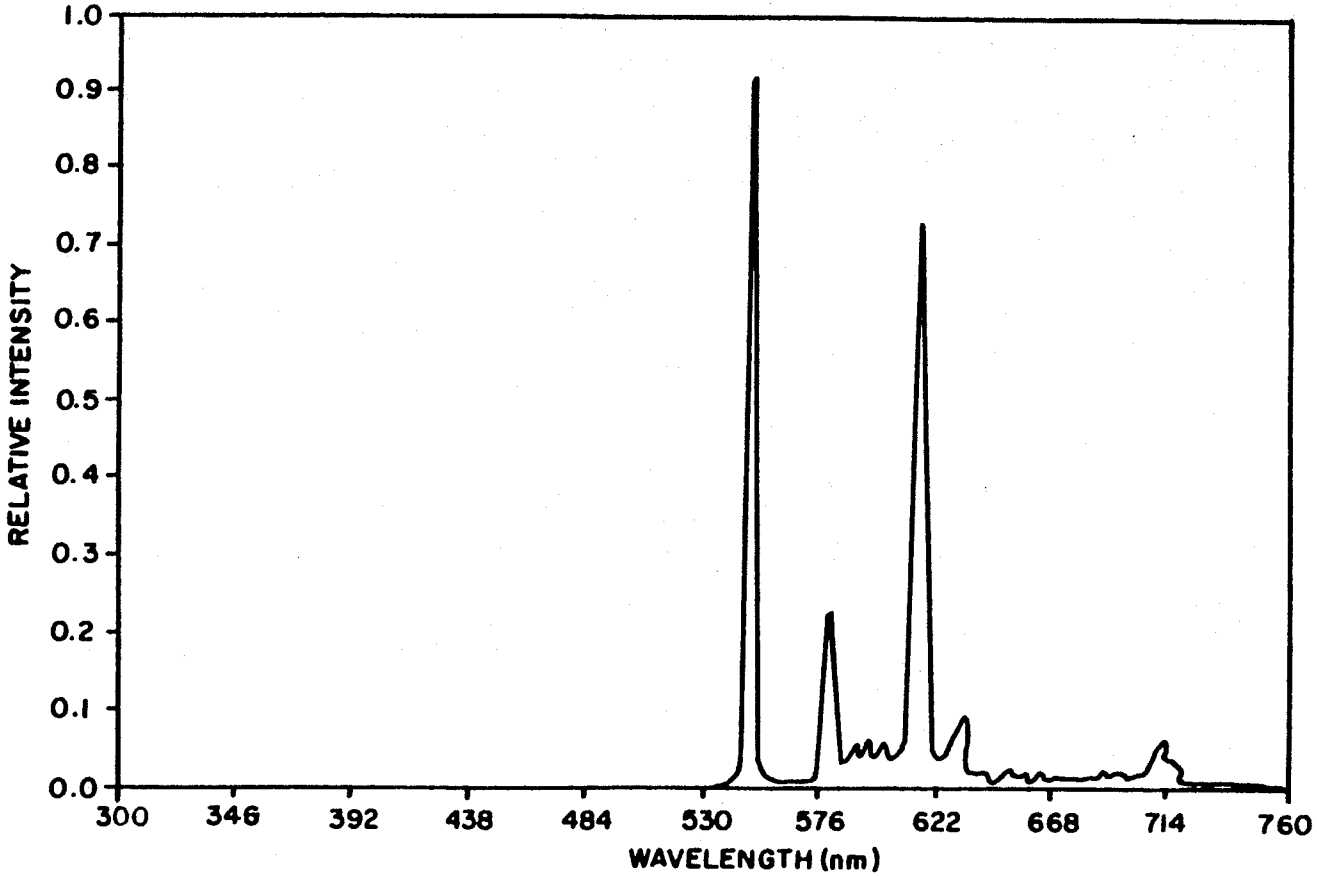
FIG. 4 is a graph depicting the spectral power distribution of a lamp made in accordance with the teachings of the present invention.

FIG. 4 is a graph depicting the spectral power distribution of a lamp as described in the above example. As shown therein, the visible emission is located principally in the 500 to 760 nanometer range. Visible mercury lines at approximately 546 and 578 nanometers are evident in the spectral power distribution.

There has thus been shown and described a fluorescent lamp suitable for use in reprographic applications. The lamps of the present invention do not require a pigmented filter coat or a conductive coating. The red color is obtained without the use of cadmium. Since a single coating on the interior of the envelope is required, the lamps can more easily be manufactured.

While there have been shown and described what are at present considered to be the preferred embodiments of the invention, it will be apparent to those skilled in the art that various changes and modifications can be made herein without departing from the scope of the invention. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A fluorescent lamp comprising:

a glass envelope having a substantially circular configuration in cross section and having opposed end portions, said envelope being capable of attenuating radiation having wavelengths below about 500 nanometers;

an electrode located within a respective one of the opposed end portions;

an ionizable medium enclosed within said envelope and including an inert starting gas and a quantity of mercury, said ionizable medium when energized generating a plasma discharge comprising ultraviolet radiation and a limited proportion of visible radiation; and a phosphor means responsive to said ultraviolet radiation generated by said plasma discharge disposed on the inner surface of said envelope and comprising a mixture of a single narrow band emitting phosphor having a peak emission in the wavelength region of from about 590 to 660 nanometers and a predetermined amount of alumina, said amount of alumina by weight being within the range of from about 55 percent to about 95 percent by weight of said phosphor.

2. The fluorescent lamp of claim 1 wherein said envelope is amber-colored.

3. The fluorescent lamp of claim 1 wherein said phosphor means contains one of at least europium-activated yttrium oxide, manganese-activated magnesium fluorogermanate, strontium magnesium orthophosphate and manganese, lead-activated calcium metasilicate.

4. The fluorescent lamp of claim 1 wherein said phosphor means includes a mixture of europium-activated yttrium oxide phosphor and said amount of alumina.

5. The fluorescent lamp of claim 4 wherein said mixture comprises approximately 10 percent by weight europium-activated yttrium oxide and 90 percent by weight alumina.

6. The fluorescent lamp of claim 4 wherein said alumina has a median particle size of about 0.85 micron.

7. A fluorescent lamp suitable for reprographic applications comprising:

an amber-colored glass envelope having a substantially circular configuration in cross section and having opposed end portions, said envelope being capable of attenuating radiation having wavelengths below about 500 nanometers;

an electrode located within a respective one of the opposed end portions;

an ionizable medium enclosed within said envelope and including an inert starting gas and a quantity of mercury, said ionizable medium when energized generating a plasma discharge comprising ultraviolet radiation and a limited proportion of visible radiation; and a phosphor means responsive to said ultraviolet radiation generated by said plasma discharge disposed on the inner surface of said envelope and comprising a mixture of a single narrow band emitting phosphor and a predetermined amount of alumina, said amount of alumina by weight being within the range of from about 55 percent to about 95 percent by weight of said phosphor.

8. The fluorescent lamp of claim 7 wherein said phosphor includes one of at least europium-activated yttrium oxide, manganese-activated magnesium fluorogermanate, strontium magnesium orthophosphate and manganese, lead-activated calcium metasilicate.

9. The fluorescent lamp of claim 7 wherein said phosphor means consists of approximately 10 percent by weight europium-activated yttrium oxide and 90 percent by weight alumina.

* * * * *